US007240383B2

(12) United States Patent
Stewart

(10) Patent No.: US 7,240,383 B2
(45) Date of Patent: Jul. 10, 2007

(54) WOVEN BED SHEET WITH ELASTOMERIC KNITTED CORNERS

(75) Inventor: Richard Stewart, Mason, OH (US)

(73) Assignee: Standard Textile Co., Inc., Cincinnati, OH (US)

( * ) Notice: Subject to any disclaimer, the term of this patent is extended or adjusted under 35 U.S.C. 154(b) by 0 days.

(21) Appl. No.: 11/162,504

(22) Filed: Sep. 13, 2005

(65) Prior Publication Data

US 2007/0056100 A1 Mar. 15, 2007

(51) Int. Cl.
*A47G 9/02* (2006.01)

(52) U.S. Cl. ..... 5/497; 5/499

(58) Field of Classification Search ..... 5/495–497, 5/499

See application file for complete search history.

(56) References Cited

U.S. PATENT DOCUMENTS

| | | | | |
|---|---|---|---|---|
| 2,162,755 | A | 6/1939 | Shauer | |
| 2,624,893 | A * | 1/1953 | Harris | 5/497 |
| 3,013,283 | A | 12/1961 | Steffinich | |
| 3,111,688 | A | 11/1963 | Barnes | |
| 3,114,156 | A * | 12/1963 | Cobb | 5/497 |
| 3,142,072 | A | 7/1964 | Goodson, Jr. | |
| 4,912,790 | A | 4/1990 | Macdonald | |
| 4,980,941 | A * | 1/1991 | Johnson, III | 5/497 |
| 5,029,353 | A * | 7/1991 | Kimball et al. | 5/497 |
| 5,127,115 | A * | 7/1992 | Williams et al. | 5/497 |
| 5,884,349 | A | 3/1999 | Gretsinger | |
| 6,164,092 | A * | 12/2000 | Menaker | 66/170 |
| 6,983,500 | B2 * | 1/2006 | Wootten | 5/497 |
| 2004/0040090 | A1 | 3/2004 | Wootten | |
| 2004/0068794 | A1 | 4/2004 | Wootten | |

OTHER PUBLICATIONS

International Search Report for PCT/US2006/000938, mailed Jun. 22, 2006.
Written Opinion for PCT/US2006/000938, mailed Jun. 22, 2006.

* cited by examiner

*Primary Examiner*—Michael Trettel
(74) *Attorney, Agent, or Firm*—Wood, Herron & Evans, LLP

(57) ABSTRACT

A contoured woven bed sheet (30) includes a woven field (12) and side panels (14, 16, 18, 20), and triangular corner inserts (40) connecting adjacent side panels. The corner inserts are knitted of elastomeric (62) and non-elastomeric (60) yarns. The elastomeric yarns (62) make up about 5% to about 25% by weight of the corner insert (40) and may be Spandex, with the remainder being a non-elastomeric material such as polyester.

62 Claims, 2 Drawing Sheets

WOVEN BED SHEET WITH ELASTOMERIC KNITTED CORNERS

FIELD OF THE INVENTION

The present invention relates to bedding and, more particularly, to contoured or fitted bed sheets.

DESCRIPTION OF RELATED ART

Historically, contoured or fitted bed sheets have been fabricated using either woven or knitted fabrics. Woven sheets are typically fabricated with an elastic strip around the bottom edge of the sheet to assist the product in remaining secured to the mattress. This is necessary because the woven fabric has no ability to grab. However, in commercial laundry environments, the elastic has a much shorter life than the woven fabric, thereby limiting the service life of the product. Further, the utility of any woven contoured bed sheet is dependent upon the sidewall depth or height, specifically for the corners. In other words, if a contour sheet is fabricated with a sidewall height of eight inches, it will accommodate only mattresses with a thickness of slightly less than eight inches. Given that mattresses are manufactured in multiple thickness, and most heath care facilities and hospitality properties have mattresses of varying thicknesses in service at any given time, this presents both service and functionality problems.

Knitted contoured bed sheets offer the versatility inherent in knitted fabrics and are better suited for accommodation of varying mattress dimensions. Also, the stretch and recovery aspect of a knit material allows these sheets to be commonly made without elastic. However, knit fabrics are known to be less durable than woven alternatives and can be more complicated and costly to process in a commercial laundry. Knitted sheets present difficulties in being effectively processed through ordinary flat work ironers or folding machinery that are employed in many industrial processing facilities. Thus, while knitted bed sheets have gained large-scale market acceptance in the health care market, the processing, handling, and finished product appearance issues associated with them have caused the hospitality industry to largely continue the use of woven products.

SUMMARY OF THE INVENTION

The present invention provides a bed sheet that serves as a contoured bed sheet having certain advantages of both woven and knitted bed sheets, but without some of the respective drawbacks thereof. To that end, and in accordance with the principles of the present invention, a contoured bed sheet is provided by a woven sheet with knitted corner inserts having both non-elastomeric synthetic yarns and elastomeric synthetic yarns, with the elastomeric yarns being present in a range of between about 5% and about 25% by weight of the corner insert. The resulting sheet can be used as a contoured bed sheet like a knit sheet, but without a separate elastic strip, yet can be easily processed through conventional commercial laundry and folding machinery. Further, the product, when in use, appears to be a typical woven contoured bed sheet.

By virtue of the foregoing, there is thus provided a contoured bed sheet with advantages of both woven and knitted bed sheets, but without some of the respective drawbacks thereof. These and other objects and advantages of the present invention shall be made apparent from the accompanying drawings and the description thereof.

BRIEF DESCRIPTION OF THE DRAWINGS

The accompanying drawings, which are incorporated in and constitute a part of this specification, illustrate an embodiment of the invention and, together with the general description of the invention given above and the detailed description of the embodiment given below, serve to explain the principles of the present invention.

DETAILED DESCRIPTION

Figure 1:
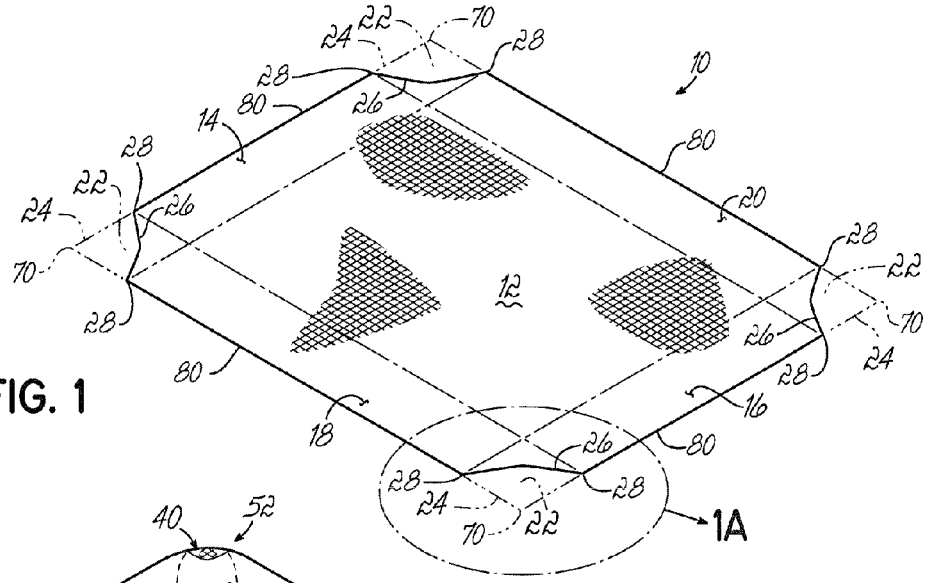
FIG. 1 is a perspective view of an exemplary woven base sheet for use in making a contoured bed sheet in accordance with the principles of the present invention.

With reference to FIG. 1, a rectangular woven base sheet 10 has a field portion 12, with opposite lengthwise top and bottom segments 14, 16, and opposite left and right widthwise side segments 18, 20 as indicated by dashed lines. Each pair of adjacent segments (such as segments 14 and 18 by way of example) overlap in a corner area 22. A corner section 24 (shown in phantom in FIG. 1) of one or more (advantageously all four) corner areas 22 of the woven sheet 10 is removed leaving a generally arcuate upper edge 26 extending between points 28 along the periphery of the respective adjacent segments, such that each segment may now be seen as constituting a lengthwise or widthwise panel. Corner section 24 may be cut such that edge 26 has a pair of inwardly extending, generally straight, edge portions 26*a*, 26*b*, that adjoin at rounded apex 26*c* as seen inf FIG. 1A. Sheet 10 can be of any woven fabric typically used in bedding such as cotton, polyester, or combinations thereof. Typically, a standard weave is employed.

Figure 3:
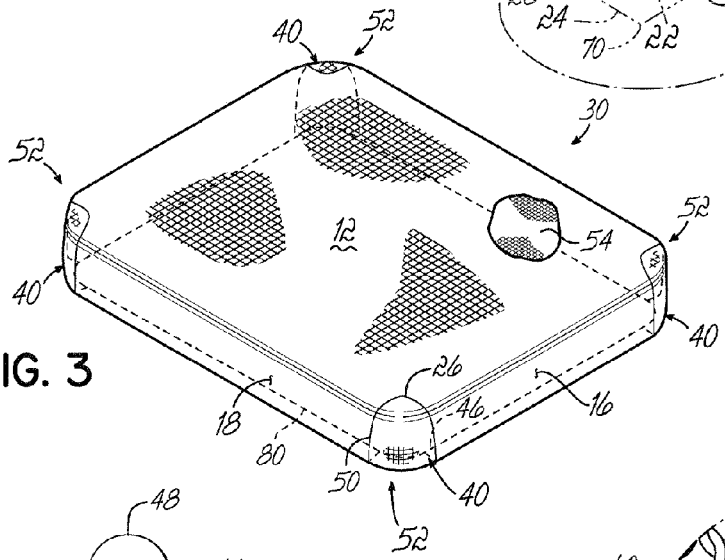
FIG. 3 is a perspective, partially cut away view of a contoured bed sheet according to the present invention made up from the woven sheet of FIG. 1 and a plurality of knitted corner inserts of FIG. 2.
Figure 2:
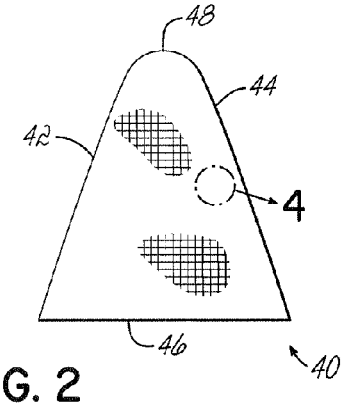
FIG. 2 is a plan view of an exemplary knitted corner insert for use with the woven sheet of FIG. 1 to make a contoured bed sheet in accordance with the principles of the present invention.

A contoured bed sheet 30 (FIG. 3) is formed by attaching to at least one, if not to a pair, or to all four, corner sections 24 between respective pairs of adjacent segments or panels (14, 20; 20, 16; 16, 18; and/or 10, 14) a knitted corner insert 40 (FIG. 2) which may, in the embodiment shown herein, be of generally triangular shaped having outer side edges 42, 44 extending from bottom side edge 46 and adjoining at rounded apex 48. The corner insert 40 is attached, such as by stitching of the edges 42, 44 and apex 48 to upper edge 26 of a corner section 24 of sheet 10. A safety stitch seam as at 50 may be used. As a consequence, each corner insert 40 joins together an adjacent pair of panels (14, 20; 20, 16; 16, 18; and/or 10, 14) to thus define stretchable corners 52 so as to function as a contoured bed sheet and receive respective corners of a mattress 54.

Figure 4:
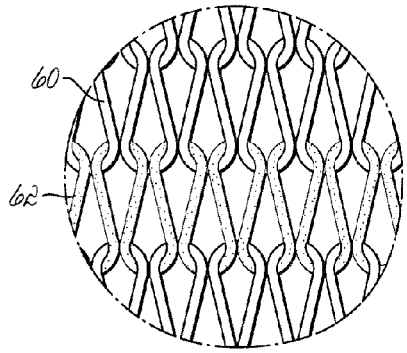
FIG. 4 is an enlarged plan view taken at encircled area 4 of FIG. 2.

Corner inserts 40 are advantageously made from a stretchable material which is knitted, either by warp or circular knitting. In order to give the advantageous results desired by the present invention, with reference to FIG. 4, corners 40 are formed by knitting together a plurality of non-elastomeric yarns 60 and a plurality of elastomeric yarns 62 (only one shown in FIG. 4), the latter advantageously making up about 5% to about 25% by weight of a corner insert 40, although making up by weight within a narrow range of about 10% to about 25% may be further advantageous. In one embodiment, a weight of elastomeric yarns 62 of corner insert 40 is about 17%. Such amounts are believed to provide for sufficient expansion, at the same time ensuring that the corners 52 adequately grab the mattress 54.

The elastomeric yarns 62 may be of any stretchable material, although an elastomeric segmented polyurethane, such as Spandex (which may be at least about 85% of segmented polyurethane), may be advantageous. The non-elastomeric yarns 60 may be any yarn that can be knitted to form the fabric corners 40, with one possibly advantageous non-elastomeric yarn being comprised of polyester. The overall weight per yard of a corner insert 40 is advantageously limited to be between about 50% and about 150% of the weight per yard of the base sheet 10. Further, corner inserts 40 are advantageously of substantially the same color as base sheet 10.

To form the bed sheet 30, corner sections 24 of an appropriate size are removed from base sheeting 10. As an example, each corner section 24 of base sheet 10 may be cut between points 28 that are each about 22.5 inches (plus or minus about a half inch) from the apex 70 at each corner area 22 to define upper edge 26 subtending a distance of about 32 inches between adjacent pairs of points 28. The maximum distance between edge apex 26*c* and apex 70 may be about 19.25 inches. The corner insert 40 side edges 42, 44, in turn, will each be about 15.25 inches long, with bottom edge 46 being about 13 inches long. The distance from the bottom edge 46 to the apex 48 may be about 14 inches.

The corners 40 are attached to the base sheeting 10 by stitching, such as safety stitching 50. Corners 40 may be attached at the rounded apex 48 to the apex 26*c* of upper edge 26, and subsequently stitched along sides 42 and 44 and respective edge portions 26*a* and 26*b*. The bottom peripheral edge 80, optionally including bottom edge(s) 46, of the entire sheet 30 may be seamed to provide a finished sheet. Because of the difference in size between cut out corner sections 24 and corner inserts 40, the corner inserts are slightly stretched when sewn into base sheet 10 to form contoured bed sheet 30.

The above bed sheet 30 provides the feel, appearance, and durability of a woven sheet. It can be processed using standard commercial laundry facilities. However, it fits on a mattress like a knitted sheet. It can also accommodate mattresses of varying thicknesses.

By virtue of the foregoing, there is thus provided a contoured bed sheet with advantages of both woven and knitted bed sheets, but without some of the respective drawbacks thereof.

While the present invention has been illustrated by the description of an embodiment thereof, and while the embodiment has been described in considerable detail, it is not intended to restrict or in any way limit the scope of the appended claims to such detail. Additional advantages and modifications will readily appear to those skilled in the art. The invention in its broader aspects is, therefore, not limited to the specific details, representative apparatus and method, and illustrative examples shown and described. Accordingly, departures may be made from such details without departing from the spirit or scope of the general inventive concept.

What is claimed is:

1. A bed sheet comprising:

a woven fabric sheet including four corners and opposite lengthwise and widthwise side panels extending between respective pairs of said four corners; and a knit corner insert associated with at least one of the corners and having a plurality of non-elastomeric synthetic polyester yarns and a plurality of elastomeric synthetic yarns, the elastomeric synthetic yarns being present in a range of between about 5% and about 25% by weight of the knit corner insert.

2. The sheet claimed in claim 1 further comprising four of the knit corner inserts each associated with a respective one of the four corners.

3. The sheet claimed in claim 1 wherein the elastomeric synthetic yarns include at least about 85% segmented polyurethane.

4. The sheet claimed in claim 3 wherein the polyester yarns comprise about 83% by weight and the polyurethane yarns comprise about 17% by weight of the knit corner insert.

5. The sheet claimed in claim 3 wherein the elastomeric synthetic yarns comprise between about 10% and about 20% by weight of the knit corner insert.

6. The sheet claimed in claim 1 wherein the elastomeric synthetic yarns comprise between about 10% and about 20% by weight of the knit corner insert.

7. The sheet claimed in claim 1, said knit corner insert being warp knitted.

8. The sheet claimed in claim 1 further comprising a pair of the knit corner inserts each associated with a respective one of at least two of the corners.

9. A method of making a bed sheet, comprising:

obtaining a length of woven fabric including four corners and opposite lengthwise and widthwise edges extending between respective pairs of the four corners;

removing a corner from the length of woven fabric;

obtaining a knit corner insert including a plurality of non-elastomeric synthetic polyester yarns and a plurality of elastomeric synthetic yarns, the elastomeric synthetic yarns being present in a range of between about 5% and about 25% by weight of the knit corner insert; and attaching the knit corner insert between adjacent edges in place of the removed corner.

10. The method of claim 9 wherein two of said corners are removed from the woven fabric, and knit corner inserts are attached to said woven fabric by attaching a respective one of two of said knit corner inserts between adjacent edges in place of each respective one of the two removed corners.

11. The method of claim 9 wherein the elastomeric synthetic yarns include at least about 85% segmented polyurethane.

12. The method of claim 11 wherein the polyester yarns comprise about 83% by weight and the polyurethane yarns comprise about 17% by weight of the knit panel corner insert.

13. The method of claim 11 wherein the elastomeric synthetic yarns comprise between about 10% and about 20% by weight of the knit corner insert.

14. The method of claim 9 wherein the elastomeric synthetic yarns comprise between about 10% and about 20% by weight of the knit corner insert.

15. The method of claim 9 wherein each of said four corners is removed from the woven fabric, and knit corner inserts are attached to said woven fabric by attaching a respective one of four of said knit corner inserts between adjacent edges in place of each respective one of the removed four corners.

16. The method of claim 15 wherein the elastomeric synthetic yarns are polyurethane and comprise 17% by weight of the knit panel corner insert, and the non-elastomeric synthetic polyester yarns comprise about 83% by weight of the knit corner insert.

17. A bed sheet comprising:

a woven fabric sheet including four corners and opposite lengthwise and widthwise side panels extending between respective pairs of said four corners, at least one of the corners including a stitching edge having a length measured between two opposing endpoints at a periphery of adjacent lengthwise and widthwise side panels longer than a straight line between the endpoints; and a knit corner insert associated with at least one of the corners along the stitching edge and having a plurality of non-elastomeric synthetic yarns and a plurality of elastomeric synthetic yarns, the elastomeric synthetic yarns being present in a range of between about 5% and about 25% by weight of the knit corner insert.

18. The sheet claimed in claim 17 wherein the elastomeric synthetic yarns include at least about 85% segmented polyurethane.

19. The sheet claimed in claim 18 wherein the elastomeric synthetic yarns comprise between about 10% and about 20% by weight of the knit corner insert.

20. The sheet claimed in claim 18 wherein the non-elastomeric synthetic yarns are polyester.

21. The sheet claimed in claim 20 wherein the polyester yarns comprise about 83% by weight and the polyurethane yarns comprise about 17% by weight of the knit corner insert.

22. The sheet claimed in claim 17 wherein the non-elastomeric synthetic yarns are polyester.

23. The sheet claimed in claim 17 wherein the elastomeric synthetic yarns comprise between about 10% and about 20% by weight of the knit corner insert.

24. The sheet claimed in claim 17, said knit corner insert being warp knitted.

25. The sheet claimed in claim 17 wherein at least a second corner includes a stitching edge having a length measured between two opposing endpoints of the second corner at a periphery of adjacent lengthwise and widthwise side panels longer than a straight line between the endpoints, with a second of the knit corner inserts attached to the stitching edge of the second corner.

26. The sheet claimed in claim 17 wherein each of the four corners includes a stitching edge having a length measured between two opposing endpoints of the respective corner at a periphery of adjacent lengthwise and widthwise panels longer than a straight line between the endpoints thereof, with one each of four of the knit corner inserts attached to a respective one of the stitching edges.

27. The sheet claimed in claim 17 wherein the stitching edge is generally arcuate between the endpoints.

28. The sheet claimed in claim 17 wherein the stitching edge includes a pair of stitching edges portions, each extending inwardly from respective ones of the endpoints toward an apex therebetween.

29. The sheet claimed in claim 28 wherein the stitching edge portions adjoin at the apex.

30. A method of making a bed sheet, comprising:

obtaining a length of woven fabric including four corners and opposite lengthwise and widthwise edges extending between respective pairs of the four corners;

defining a stitching edge at a corner of the woven fabric having a length measured between two opposing endpoints at a periphery of adjacent lengthwise and widthwise side panels longer than a straight line between the endpoints;

obtaining a knit corner insert including a plurality of non-elastomeric synthetic yarns and a plurality of elastomeric synthetic yarns, the elastomeric synthetic yarns being present in a range of between about 5% and about 25% by weight of the knit corner insert; and attaching the knit corner insert along the stitching edge between adjacent lengthwise and widthwise edges at the corner.

31. The method of claim 30 wherein the elastomeric synthetic yarns include at least about 85% segmented polyurethane.

32. The method of claim 31 wherein the elastomeric synthetic yarns comprise between about 10% and about 20% by weight of the knit corner insert.

33. The method of claim 31 wherein the non-elastomeric synthetic yarns are polyester.

34. The method of claim 33 wherein the polyester yarns comprise about 83% by weight and the polyurethane yarns comprise about 17% by weight of the knit panel corner insert.

35. The method of claim 30 wherein the non-elastomeric synthetic yarns are polyester.

36. The method of claim 30 wherein the elastomeric synthetic yarns comprise between about 10% and about 20% by weight of the knit corner insert.

37. The method of claim 34 wherein stitching edges are defined at two corners of the woven fabric and two of the knit corner inserts are attached to said woven fabric by attaching a respective one of the knit corner inserts along respective ones of the stitching edges between adjacent lengthwise and widthwise edges of the two corners.

38. The method of claim 30 wherein stitching edges are defined at each of said four corners of the woven fabric and four of the knit corner inserts are attached to said woven fabric by attaching a respective one of each of the knit corner inserts along a respective one of the stitching edges between adjacent lengthwise and widthwise edges in of the four corners.

39. The method of claim 38 wherein the elastomeric synthetic yarns are polyurethane and comprise 17% by weight of the knit panel corner insert, and the non-elastomeric synthetic yarns are polyester and comprise about 83% by weight of the knit corner insert.

40. The method of claim 30 wherein the stitching edge is generally arcuate between the endpoints.

41. The method of claim 30 wherein the stitching edge includes a pair of stitching edges portions, each extending inwardly from respective ones of the endpoints toward an apex therebetween.

42. The method of claim 30 wherein the corner is removed to define the stitching edge.

43. A bed sheet comprising:

a woven fabric sheet including four corners and opposite lengthwise and widthwise side panels extending between respective pairs of said four corners, at least one corner consisting essentially of a one-piece knit corner insert having a plurality of non-elastomeric synthetic yarns and a plurality of elastomeric synthetic yarns, the elastomeric synthetic yarns being present in a range of between about 5% and about 25% by weight of the knit corner insert.

44. The sheet claimed in claim 43 wherein the elastomeric synthetic yarns include at least about 85% segmented polyurethane.

45. The sheet claimed in claim 44 wherein the elastomeric synthetic yarns comprise between about 10% and about 20% by weight of the knit corner insert.

46. The sheet claimed in claim 44 wherein the non-elastomeric synthetic yarns are polyester.

47. The sheet claimed in claim 46 wherein the polyester yarns comprise about 83% by weight and the polyurethane yarns comprise about 17% by weight of the knit corner insert.

48. The sheet claimed in claim 43 wherein the non-elastomeric synthetic yarns are polyester.

49. The sheet claimed in claim 43 wherein the elastomeric synthetic yarns comprise between about 10% and about 20% by weight of the knit corner insert.

50. The sheet claimed in claim 43, said knit corner insert being warp knitted.

51. The sheet claimed in claim 43 wherein at least two of the corners each consist essentially of said one-piece knit corner inserts.

52. The sheet claimed in claim 43 wherein each of the four corners consist essentially of said one-piece knit corner inserts.

53. A method of making a bed sheet, comprising:

obtaining a length of woven fabric including four corners and opposite lengthwise and widthwise edges extending between respective pairs of the four corners;

removing a corner from the length of woven fabric;

obtaining a knit corner insert including a plurality of non-elastomeric synthetic yarns and a plurality of elastomeric synthetic yarns, the elastomeric synthetic yarns being present in a range of between about 5% and about 25% by weight of the knit corner insert; and attaching between adjacent edges in place of the removed corner essentially only the one-piece knit corner insert such that the corner of the bed sheet consists essentially of the one-piece knit corner insert.

54. The method of claim 53 wherein the elastomeric synthetic yarns include at least about 85% segmented polyurethane.

55. The method of claim 54 wherein the elastomeric synthetic yarns comprise between about 10% and about 20% by weight of the knit corner insert.

56. The method of claim 54 wherein the non-elastomeric synthetic yarns are polyester.

57. The method of claim 56 wherein the polyester yarns comprise about 83% by weight and the polyurethane yarns comprise about 17% by weight of the knit panel corner insert.

58. The method of claim 53 wherein the non-elastomeric synthetic yarns are polyester.

59. The method of claim 53 wherein the elastomeric synthetic yarns comprise between about 10% and about 20% by weight of the knit corner insert.

60. The method of claim 53 further comprising removing a second of the corners from the woven fabric, obtaining a second of the knit corner inserts, and attaching between adjacent edges in place of the removed second corner essentially only the second one-piece knit corner insert such that the second corner of the bed sheet consists essentially of the second one-piece knit corner insert.

61. The method of claim 53 further comprising removing each of said four corners from the woven fabric, obtaining four of said one-piece knit corner inserts, and attaching between adjacent edges in place of each respective one of the removed four corners essentially only a respective one of four knit corner inserts such that the four corners of the bed sheet each consists essentially of one-piece knit corner inserts.

62. The method of claim 61 wherein the elastomeric synthetic yarns are polyurethane and comprise 17% by weight of the knit panel corner insert, and the non-elastomeric synthetic yarns are polyester and comprise about 83% by weight of the knit corner insert.

* * * * *

UNITED STATES PATENT AND TRADEMARK OFFICE

CERTIFICATE OF CORRECTION

PATENT NO. : 7,240,383 B2
APPLICATION NO. : 11/162504
DATED : July 10, 2007
INVENTOR(S) : Richard Stewart It is certified that error appears in the above-identified patent and that said Letters Patent is hereby corrected as shown below:

Column 1
Line 25, "...in multiple thickness..." should be -- ...in multiple thicknesses... --

Figure 1A:
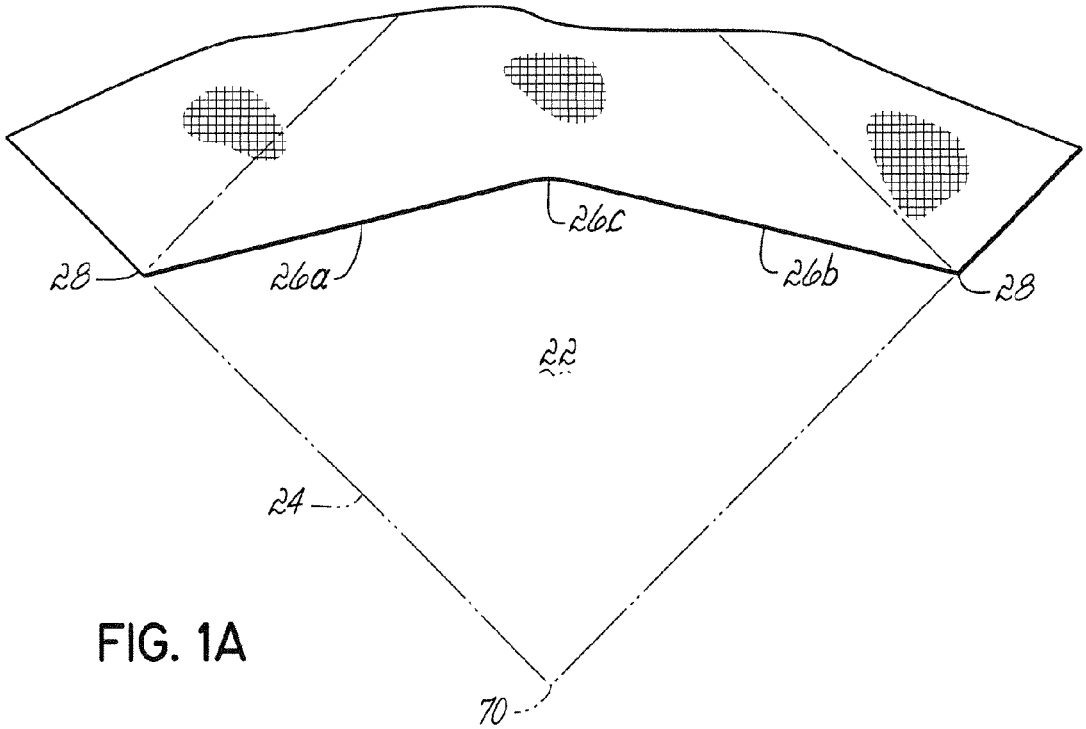
FIG. 1A is a top plan view taken at encircled area 1A of FIG. 1.

Column 2
Line 41, "...as seen inf FIG. 1A." should be -- as seen in FIG. 1A. --
Line 50, "...of generally triangular shaped having..." should be -- ...of generally triangular shape having... --

Claim 28
Column 5, Line 55, "...a pair of stitching edges portions..." should be -- a pair of stitching edge portions --

Claim 37
Column 6, line 29, "The method of claim 34 wherein " should be -- "The method of claim 30 wherein... --

Claim 38
Column 6, line 40, "...edges in of the four corners." should be -- ...edges in one of the four corners. --

Claim 41
Column 6, line 50, "...a pair of stitching edges portions..." should be -- a pair of stitching edge portions... --

Signed and Sealed this

Eleventh Day of March, 2008

JON W. DUDAS
*Director of the United States Patent and Trademark Office*